US007947860B2

(12) United States Patent
Schultz et al.

(10) Patent No.: US 7,947,860 B2
(45) Date of Patent: May 24, 2011

(54) DIVIDING WALL SEPARATION IN LIGHT OLEFIN HYDROCARBON PROCESSING

(75) Inventors: Michael A. Schultz, Chicago, IL (US); Keith A. Couch, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 844 days.

(21) Appl. No.: 11/540,110

(22) Filed: Sep. 28, 2006

(65) Prior Publication Data

US 2008/0081937 A1 Apr. 3, 2008

(51) Int. Cl.
*C07C 4/02* (2006.01)

(52) U.S. Cl. ..... 585/648; 585/324; 585/329; 585/638; 585/639; 585/640; 585/644; 585/650; 585/651; 585/653; 208/49; 208/70; 208/92; 208/100; 208/208 R; 208/209; 208/210; 208/211

(58) Field of Classification Search ..... 585/324, 585/329, 638, 639, 640, 644, 648, 650, 651, 585/653; 208/49, 70, 92, 100, 208 R, 209, 208/210, 211, 237
See application file for complete search history.

(56) References Cited

U.S. PATENT DOCUMENTS

| | | | | |
|---|---|---|---|---|
| 3,702,886 | A | 11/1972 | Argauer et al. | |
| 5,110,446 | A * | 5/1992 | Harandi et al. | 208/100 |
| 5,220,097 | A | 6/1993 | Lam et al. | 585/809 |
| 5,360,533 | A | 11/1994 | Tagamolila et al. | |
| 5,584,985 | A | 12/1996 | Lomas | |
| 5,858,206 | A | 1/1999 | Castillo | |
| 5,914,433 | A | 6/1999 | Marker | |
| 6,049,017 | A * | 4/2000 | Vora et al. | 585/324 |
| 6,538,169 | B1 | 3/2003 | Pittman et al. | |
| 6,726,835 | B2 | 4/2004 | Towler et al. | 208/211 |
| 6,843,906 | B1 | 1/2005 | Eng | |
| 6,927,314 | B1 | 8/2005 | Schultz et al. | 585/734 |
| 2003/0116474 | A1 * | 6/2003 | Towler et al. | 208/237 |

FOREIGN PATENT DOCUMENTS

EP 1 637 577 A2 3/2006

* cited by examiner

*Primary Examiner* — Prem C Singh
(74) *Attorney, Agent, or Firm* — James C Paschall

(57) ABSTRACT

Processing schemes and arrangements for application of a dividing wall separation column in the processing of an effluent resulting from FCC processing modified for increased light olefin production. The dividing wall separation column desirably splits a naphtha feedstock produced or resulting from such modified FCC processing to produce or form a light fraction containing $C_5$-$C_6$ compounds, an intermediate fraction containing $C_7$-$C_8$ compounds and a heavy fraction containing $C_9$+ compounds.

19 Claims, 2 Drawing Sheets

DIVIDING WALL SEPARATION IN LIGHT OLEFIN HYDROCARBON PROCESSING

BACKGROUND OF THE INVENTION

This invention relates generally to hydrocarbon processing and, more particularly, to the processing of a resulting naphtha process stream via a dividing wall separation column to form or obtain process streams composed of hydrocarbons containing particular desired ranges of carbon atoms.

A major portion of the worldwide petrochemical industry is concerned with the production of light olefin materials and their subsequent use in the production of numerous important chemical products via polymerization, oligomerization, alkylation and the like well-known chemical reactions. Light olefins include ethylene, propylene and mixtures thereof. These light olefins are essential building blocks in the modern petrochemical and chemical industries.

Light olefins have traditionally been produced through the processes of steam or catalytic cracking of hydrocarbons such as derived from petroleum sources. Fluidized catalytic cracking (FCC) of heavy hydrocarbon streams is commonly carried out by contacting a starting material whether it be vacuum gas oil, reduced crude, or another source of relatively high boiling hydrocarbons with a catalyst such as composed of finely divided or particulate solid material. The catalyst is transported in a fluid-like manner by transmitting a gas or vapor through the catalyst at sufficient velocity to produce a desired regime of fluid transport. Contact of the oil with the fluidized material catalyzes the cracking reaction.

The cracking reaction typically deposits coke on the catalyst. Catalyst exiting the reaction zone is commonly referred to as being "spent", i.e., partially deactivated by the deposition of coke upon the catalyst. Coke is comprised of hydrogen and carbon and can include, in trace quantities, other materials such as sulfur and metals such that may enter the process with the starting material. The presence of coke interferes with the catalytic activity of the spent catalyst. It is believed that the coke blocks acid sites on the catalyst surface where the cracking reactions take place. Spent catalyst is traditionally transferred to a stripper that removes adsorbed hydrocarbons and gases from catalyst and then to a regenerator for the purpose of removing the coke by oxidation with an oxygen-containing gas. An inventory of catalyst having a reduced coke content, relative to the spent catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated between the reaction zone and the regeneration zone. The fluidized catalyst, as well as providing a catalytic function, acts as a vehicle for the transfer of heat from zone to zone. FCC processing is more fully described in U.S. Pat. No. 5,360,533 to Tagamolila et al., U.S. Pat. No. 5,584,985 to Lomas, U.S. Pat. No. 5,858,206 to Castillo and U.S. Pat. No. 6,843,906 B1 to Eng, the contents of each of these patents are hereby incorporated herein by reference. Specific details of the various contact zones, regeneration zones, and stripping zones along with arrangements for conveying the catalyst between the various zones are well known to those skilled in the art.

Such FCC processing typically results in the formation of a product or effluent stream containing a distribution of hydrocarbon products having a range of carbon atoms. Consequently, such processing also is typically associated with hydrocarbon recovery processing to recover specified fractions or portions of the product hydrocarbons for use as is or after subsequent or additional processing. For example, ethylene and propylene can be recovered as desired products such as in the form of polymer grade feedstocks for use in corresponding or associated poly units. More specifically, cracked vapors from an FCC unit enter a separation zone, typically in the form of a main column, that provides a gas stream, a gasoline cut, light cycle oil (LCO) and clarified oil (CO) which includes heavy cycle oil (HCO) components. In conventional FCC processing, such gas stream is commonly further processed through a gas concentration system such as to produce a dry gas stream, i.e., hydrogen, $C_1$ and $C_2$ hydrocarbons and typically less than 5 mol % $C_3$+ hydrocarbons, a mixed liquefied petroleum gas ("LPG") stream, i.e., $C_3$ and $C_4$ hydrocarbons, also sometimes commonly referred to as wet gas and a stabilized naphtha stream. The naphtha can then be stripped to remove the $C_2$− materials and then debutanized to remove the LPG.

In view of an increasing need and demand for light olefins such as ethylene and propylene for various petrochemical uses such as for the production of polyethylene, polypropylene and the like as well as the desire to produce relatively less of heavier olefins such as butylenes and pentenes which are generally less desirable as gasoline blending components due to environmental considerations, it may be desired to practice cracking reaction processing of heavy hydrocarbon feedstock to increase the relative amount of light olefins in the resulting product slate.

Research efforts have led to the development of an FCC process that produces or results in greater relative yields of light olefins, i.e., ethylene and propylene. Such processing is more fully described in U.S. Pat. No. 6,538,169 B1 to Pittman et al., the contents of which are hereby fully incorporated herein by reference. As disclosed therein, a hydrocarbon feed stream can desirably be contacted with a blended catalyst comprising regenerated catalyst and coked catalyst. The catalyst has a composition including a first component and a second component. The second component comprises a zeolite with no greater than medium pore size wherein the zeolite comprises at least 1 wt. % of the catalyst composition. The contacting occurs in a riser to crack hydrocarbons in the feed stream and obtain a cracked stream containing hydrocarbon products including light olefins and coked catalyst. The cracked stream is passed out of an end of the riser such that the hydrocarbon feed stream is in contact with the blended catalyst in the riser for less than or equal to 2 seconds on average.

In addition, it has been proposed that the amounts of light olefins resulting from at least certain kinds of hydrocarbon processing can be further increased by reacting, i.e., cracking, heavier hydrocarbon products, particularly heavier olefins such as $C_4$-$C_6$ olefins, to light olefins. U.S. Pat. No. 5,914,433 to Marker, the entire disclosure of which is fully incorporated herein by reference, discloses a process for the production of light olefins comprising olefins having from 2 to 4 carbon atoms per molecule from an oxygenate feedstock. The process comprises passing an oxygenate feedstock to an oxygenate conversion zone containing a metal aluminophosphate catalyst to produce a light olefin stream. A propylene stream and/or mixed butylene is fractionated from said light olefin stream and cracked to enhance the yield of ethylene and propylene products.

While such FCC and olefin cracking processing have proven generally effective in the production of desired light olefins, further improvements have been and are being sought. In particular, improvements in post-FCC process stream handling have been sought such as to either or both simplify and increase efficiency and/or effectiveness of desired further downstream processing. More specifically, further improvements in the processing of the resulting effluent materials particularly in producing desired sharper splits of the hydrocarbon products than have heretofore been commonly obtainable and, more particularly, doing so in a more energy efficient manner have been sought and are desired.

SUMMARY OF THE INVENTION

A general object of the invention is to provide improved processing of hydrocarbon streams such as resulting from an FCC process designed or operated for obtaining increased relative amounts of light olefins.

A more specific objective of the invention is to overcome one or more of the problems described above.

The general object of the invention can be attained, at least in part, through a specific process for treating a naphtha feedstock including $C_5$ to $C_9$+ hydrocarbons. In accordance with one preferred embodiment, such a process involves introducing the naphtha feedstock including $C_5$ to $C_9$+ hydrocarbons into a dividing wall separation column and separating the feedstock into a light fraction that includes compounds containing five to six carbon atoms, an intermediate fraction that includes compounds containing seven to eight carbon atoms and a heavy fraction that includes compounds containing more than eight carbon atoms.

The prior art generally fails to provide or result in processing that produces or provides as sharp as desired splits of desired hydrocarbon products from such FCC processing and, in particular, fails to provide as energy efficient manner of doing so as has been desired.

The invention further comprehends a process for producing petrochemical feedstocks. In accordance with one embodiment, such a process involves introducing a hydrocarbon feed into a fluid catalytic cracker reactor zone to produce a reactor zone effluent that includes a naphtha feedstock including $C_5$ to $C_9$+ hydrocarbons. At least a portion of the naphtha feedstock including $C_5$ to $C_9$+ hydrocarbons is recovered from the reactor zone effluent. At least a portion of the recovered naphtha feedstock including $C_5$ to $C_9$+ hydrocarbons is introduced into a dividing wall separation column, with the feedstock separating into a light fraction that includes compounds containing five to six carbon atoms, an intermediate fraction that includes compounds containing seven to eight carbon atoms and a heavy fraction that includes compounds containing more than eight carbon atoms. At least a portion of the light fraction compounds containing five to six carbon atoms is cracked to form a cracked olefin effluent that comprises $C_2$ and $C_3$ olefins. Aromatic hydrocarbons are recovered from the intermediate fraction compounds containing seven to eight carbon atoms. The heavy fraction compounds containing more than eight carbon atoms are selectively blended into a gasoline hydrocarbon-containing stream.

The invention still further comprehends a system for producing petrochemical feedstocks. Such a system, in accordance with one embodiment, includes a fluid catalytic cracker reactor zone wherein a hydrocarbon feed reacts to produce a reactor zone effluent that includes a naphtha feedstock that includes $C_5$ to $C_9$+ hydrocarbons. The system further includes a recovery zone wherein at least a portion of the naphtha feedstock comprising $C_5$ to $C_9$+ hydrocarbon is recovered from the reactor zone effluent. A dividing wall separation column is provided wherein at least a portion of the recovered naphtha feedstock comprising $C_5$ to $C_9$+ hydrocarbon is separated to form a light fraction comprising compounds containing five to six carbon atoms, an intermediate fraction comprising compounds containing seven to eight carbon atoms and a heavy fraction comprising compounds containing more than eight carbon atoms. A light fraction compound cracking zone is provided wherein at least a portion of the light fraction compounds containing five to six carbon atoms are cracked to form a cracked olefin effluent comprising $C_2$ and $C_3$ olefins. The system further includes an aromatic hydrocarbon recovery zone wherein aromatic hydrocarbons are recovered from the intermediate fraction compounds containing seven to eight carbon atoms. The system also includes a blending zone wherein the heavy fraction compounds containing more than eight carbon atoms are selectively blended into a gasoline hydrocarbon-containing stream.

As used herein, references to "light olefins" are to be understood to generally refer to $C_2$ and $C_3$ olefins, i.e., ethylene and propylene, alone or in combination.

As described in greater detail below, references herein to "ethylene-rich hydrocarbon-containing streams" are to be understood to generally refer to hydrocarbon-containing streams that generally contain at least 20 percent ethylene and, in accordance with at least certain preferred embodiments alternatively contain at least 25 percent ethylene, at least 30 percent ethylene, at least 35 percent ethylene, at least 40 percent ethylene or about 40 to about 60 percent ethylene.

References to "$C_x$ hydrocarbon" are to be understood to refer to hydrocarbon molecules having the number of carbon atoms represented by the subscript "x". Similarly, the term "$C_x$– containing stream" refers to a stream that contains $C_x$ hydrocarbon. The term "$C_x$+ hydrocarbons" refers to hydrocarbon molecules having the number of carbon atoms represented by the subscript "x" or greater. For example, "$C_4$+ hydrocarbons" include $C_4$, $C_5$ and higher carbon number hydrocarbons. The term "$C_x$– hydrocarbons" refers to hydrocarbon molecules having the number of carbon atoms represented by the subscript "x" or fewer. For example, "$C_4$– hydrocarbons" include $C_4$, $C_3$ and lower carbon number hydrocarbons.

Other objects and advantages will be apparent to those skilled in the art from the following detailed description taken in conjunction with the appended claims and drawings.

DETAILED DESCRIPTION OF THE INVENTION

A suitable heavy hydrocarbon feedstock can be cracked and the effluent resulting therefrom processed using a dividing wall separation column, in accordance with a preferred embodiment, to produce or form hydrocarbon product streams having desirably sharper splits of the hydrocarbon products than have heretofore been commonly obtainable and, more particularly, to do so in a manner that may desirably also be more energy efficient.

Figure 1:
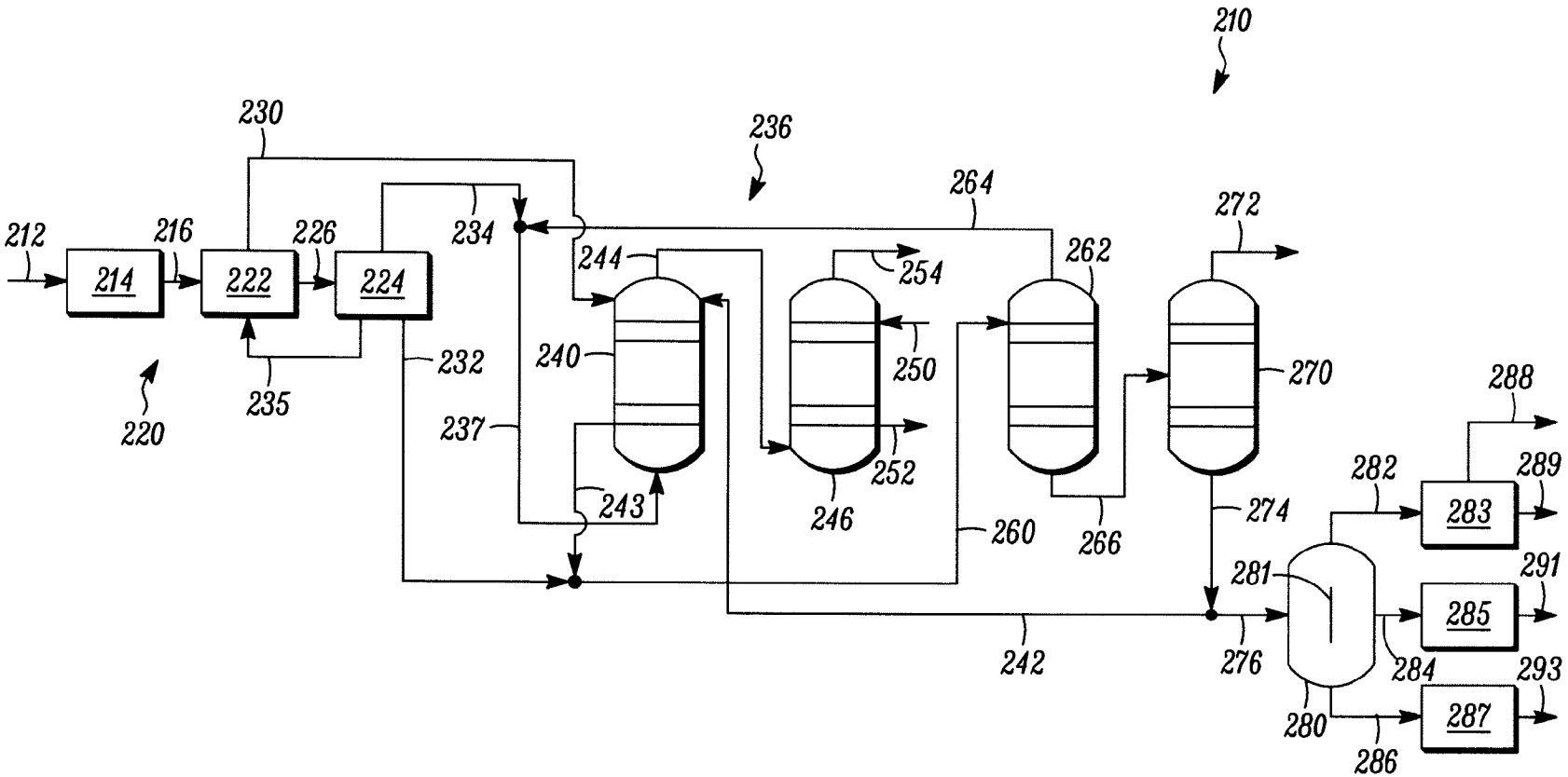
FIG. 1 is a simplified schematic diagram of a system for catalytic cracking a heavy hydrocarbon feedstock and recovering desired hydrocarbon fractions therefrom.

FIG. 1 schematically illustrates a system, generally designated by the reference numeral 210, for catalytic cracking a heavy hydrocarbon feedstock and obtaining selected hydrocarbon fractions from the effluent resulting therefrom, in accordance with one embodiment of the invention. It is to be understood that no unnecessary limitation to the scope of the claims which follow is intended by the following description. Those skilled in the art and guided by the teachings herein provided will recognize and appreciate that the illustrated system or process flow diagram has been simplified by the elimination of various usual or customary pieces of process equipment including some heat exchangers, process control systems, pumps, fractionation systems, and the like. It may also be discerned that the process flow depicted in the figure may be modified in many aspects without departing from the basic overall concept of the invention.

In the system 210, a suitable heavy hydrocarbon feedstock stream is introduced via a line 212 into a fluidized reactor zone 214 wherein the heavy hydrocarbon feedstock contacts with a hydrocarbon cracking catalyst zone to produce a hydrocarbon effluent comprising a range of hydrocarbon products, including light olefins.

Suitable fluidized catalytic cracking reactor zones for use in the practice of such an embodiment may, as is described in above-identified U.S. Pat. No. 6,538,169 B1 to Pittman et al., include a separator vessel, a regenerator, a blending vessel, and a vertical riser that provides a pneumatic conveyance zone in which conversion takes place. The arrangement circulates catalyst and contacts feed in a specifically described manner.

More specifically and as described therein, the catalyst typically comprises two components that may or may not be on the same matrix. The two components are circulated throughout the entire system. The first component may include any of the well-known catalysts that are used in the art of fluidized catalytic cracking, such as an active amorphous clay-type catalyst and/or a high activity, crystalline molecular sieve. Molecular sieve catalysts are preferred over amorphous catalysts because of their much-improved selectivity to desired products. Zeolites are the most commonly used molecular sieves in FCC processes. Preferably, the first catalyst component comprises a large pore zeolite, such as a Y-type zeolite, an active alumina material, a binder material, comprising either silica or alumina and an inert filler such as kaolin.

The zeolitic molecular sieves appropriate for the first catalyst component should have a large average pore size. Typically, molecular sieves with a large pore size have pores with openings of greater than 0.7 nm in effective diameter defined by greater than 10 and typically 12 membered rings. Pore Size Indices of large pores are above about 31. Suitable large pore zeolite components include synthetic zeolites such as X-type and Y-type zeolites, mordenite and faujasite. It has been found that Y zeolites with low rare earth content are preferred in the first catalyst component. Low rare earth content denotes less than or equal to about 1.0 wt-% rare earth oxide on the zeolite portion of the catalyst. Octacat™ catalyst made by W. R. Grace & Co. is a suitable low rare earth Y-zeolite catalyst.

The second catalyst component comprises a catalyst containing, medium or smaller pore zeolite catalyst exemplified by ZSM-5, ZSM-11, ZSM-12, ZSM-23, ZSM-35, ZSM-38, ZSM-48, and other similar materials. U.S. Pat. No. 3,702,886 describes ZSM-5. Other suitable medium or smaller pore zeolites include ferrierite, erionite, and ST-5, developed by Petroleos de Venezuela, S.A. The second catalyst component preferably disperses the medium or smaller pore zeolite on a matrix comprising a binder material such as silica or alumina and an inert filer material such as kaolin. The second component may also comprise some other active material such as Beta zeolite. These catalyst compositions have a crystalline zeolite content of 10-25 wt. % or more and a matrix material content of 75-90 wt. %. Catalysts containing 25 wt. % crystalline zeolite material are preferred. Catalysts with greater crystalline zeolite content may be used, provided they have satisfactory attrition resistance. Medium and smaller pore zeolites are characterized by having an effective pore opening diameter of less than or equal to 0.7 nm, rings of 10 or fewer members and a Pore Size Index of less than 31.

The total catalyst composition should contain 1-10 wt. % of a medium to small pore zeolite with greater than or equal to 1.75 wt. % being preferred. When the second catalyst component contains 25 wt. % crystalline zeolite, the composition contains 4-40 wt. % of the second catalyst component with a preferred content of greater than or equal to 7 wt. %. ZSM-5 and ST-5 type zeolites are particularly preferred since their high coke resistivity will tend to preserve active cracking sites as the catalyst composition makes multiple passes through the riser, thereby maintaining overall activity. The first catalyst component will comprise the balance of the catalyst composition. The relative proportions of the first and second components in the catalyst composition will not substantially vary throughout the FCC unit.

The high concentration of the medium or smaller pore zeolite in the second component of the catalyst composition improves selectivity to light olefins by further cracking the lighter naphtha range molecules. But at the same time, the resulting smaller concentration of the first catalyst component still exhibits sufficient activity to maintain conversion of the heavier feed molecules to a reasonably high level.

The relatively heavier feeds suitable for processing in accordance herewith include conventional FCC feedstocks or higher boiling or residual feeds. A common conventional feedstock is vacuum gas oil which is typically a hydrocarbon material prepared by vacuum fractionation of atmospheric residue and which has a broad boiling range of from 315-622° C. (600-1150° F.) and, more typically, which has a narrower boiling point range of from 343-551° C. (650-1025° F.). Heavy or residual feeds, i.e., hydrocarbon fractions boiling above 499° C. (930° F.), are also suitable. The fluidized catalytic cracking processing the invention is typically best suited for feedstocks that are heavier than naphtha range hydrocarbons boiling above about 177° C. (350° F.).

The effluent or at least a selected portion thereof is passed from the fluidized reactor zone 214 through a line 216 into a hydrocarbon separation system 220, such as includes a main column section 222 and a staged compression section 224. The main column section 222 may desirably include a main column separator with an associated main column overhead high pressure receiver wherein the fluidized reactor zone effluent can be separated into desired fractions including a main column vapor stream, such as passed through a line 226, and a main column liquid stream, such as passed through a line 230.

To facilitate illustration and discussion, other fraction lines such as including a heavy gasoline stream, a light cycle oil ("LCO") stream, a heavy cycle oil ("HCO") stream and a clarified oil ("CO") stream, for example, may not here be shown nor hereinafter specifically described.

The main column vapor stream line 226 is introduced into the staged compression section 224, such as constituting a two-stage compression. The staged compression section 224 results in the formation of a high pressure separator liquid stream in a line 232 and a high pressure separator vapor stream in a line 234. While the pressure of such high pressure liquid and high pressure vapor can vary, in practice such streams are typically at a pressure in the range of about 1375 kPag to about 2100 kPag (about 200 psig to about 300 psig). The compression section 224 may also result in the formation of a stream of spill back materials largely composed of heavier hydrocarbon materials and such as can be returned to the main column section 222 via a line 235.

The high pressure separator liquid stream includes $C_3$+ hydrocarbons and is substantially free of carbon dioxide. The high pressure separator vapor stream includes $C_3$− hydrocarbons and includes a quantity of carbon dioxide.

The separator vapor stream line 234 is introduced into an absorption zone, generally designated by the reference numeral 236, via a line 237. The absorption zone 236 includes a primary absorber 240 wherein the separator vapor stream contacts with a debutanized gasoline material provided by the line 242 and the main column liquid stream provided by the line 230 to absorb $C_3$+ hydrocarbons and separate $C_2$ and lower boiling fractions from the gas to the primary absorber 240. In general, the absorption zone 236 includes a primary absorber that suitably includes a plurality of stages with at least one and preferably two or more intercoolers interspaced therebetween to assist in achieving desired absorption. In practice, such a primary absorber may desirably include about five absorber stages between each pair intercoolers. Thus, a primary absorber to achieve desired absorption in accordance with one preferred embodiment desirably includes at least about 15 ideal stages with at least 2 intercoolers appropriately spaced therebetween. In another preferred embodiment, a suitable preferred primary absorber to achieve desired absorption desirably includes at least about 20 ideal stages with at least 3 intercoolers appropriately spaced therebetween. In yet another preferred embodiment, a suitable preferred primary absorber to achieve desired absorption desirably includes at about 20 to about 25 ideal stages with 4 or more intercoolers appropriately spaced therebetween. While the broader practice of the invention is not necessarily so limited, in at least certain preferred embodiments, it has been found advantageous to employ propylene as a refrigerant in one or more of such primary absorber the intercoolers to assist in achieving the desired absorption.

$C_3$+ hydrocarbons absorbed in or by the debutanized gasoline and main column liquid can be passed via a line 243 for further processing in accordance with the invention as later described herein.

The off gas from the primary absorber 240 passes via a line 244 to a secondary or sponge absorber 246. The secondary absorber 246 contacts the off gas with light cycle oil from a line 250. The light cycle oil absorbs most of the remaining $C_4$ and higher hydrocarbons and returns to the main fractionator via a line 252. A stream of $C_2$− hydrocarbons is withdrawn as off gas from the secondary or sponge absorber 246 in a line 254 for further treatment or processing such as known in the art. In accordance with a preferred embodiment, the stream withdrawn from the secondary or sponge absorber 246 in the line 254 is desirably an ethylene-rich hydrocarbon-containing stream, as herein defined.

The separator liquid stream in the line 232 and contents from the line 243 are passed through a line 260 into a stripper 262 which removes most of the $C_2$ and lighter gases in a line 264. In practice, such a stripper can desirably be operated at a pressure in the range of about 1650 kPag to about 1800 kPag (about 240 psig to about 260 psig) with a $C_2/C_3$ molar ratio in the stripper bottoms of less than 0.001 and preferably no more than about 0.0002 to about 0.0004.

As shown, $C_2$ and lighter gases in the line 264 can desirably be combined with high pressure separator vapor from the line 234 to form the line 237 that feeds into the primary absorber 240. The stripper 262 supplies a liquid $C_3$+ stream via a line 266 to a debutanizer 270. A suitable such debutanizer, in accordance with one preferred embodiment, includes a condenser (not specifically shown) that desirably operates at a pressure in the range of about 965 kPag to about 1105 kPag (about 140 psig to about 160 psig), with no more than about 5 mol % $C_5$ hydrocarbons in the overhead and no more than about 5 mol % $C_4$ hydrocarbons in the bottoms. More preferably, the relative amount of $C_5$ hydrocarbons in the overhead is less than about 1-3 mol % and the relative amount of $C_4$ hydrocarbons in the bottoms is less than about 1-3 mol %.

A stream of $C_3$ and $C_4$ hydrocarbons from the debutanizer 270 are taken overhead by a line 272 for further treatment or processing such as known in the art.

A line 274 withdraws a stream of debutanized gasoline from the debutanizer 270. A portion of the stream of debutanized gasoline is returned to the primary absorber 240 via the line 242 to serve as the first absorbent solvent. Another portion of the stream of debutanized gasoline is passed in a line 276 to a naphtha splitter 280.

In accordance with one preferred embodiment, the naphtha splitter 280 is desirably in the form of a dividing wall separation column, such as having a dividing wall 281 positioned therewithin. Such a dividing wall separation column naphtha splitter is desirably effective to separate the debutanized gasoline introduced therein into a light fraction stream comprising compounds containing five to six carbon atoms, an intermediate fraction stream comprising compounds containing seven to eight carbon atoms, and a heavy fraction stream comprising compounds containing more than eight carbon atoms. More specifically, such a dividing wall separation column may generally operate at a condenser pressure in the range of about 34 kPag to about 104 kPag (about 5 psig to about 15 psig) and, in accordance with one embodiment operated at a condenser pressure of about 55 kPag to about 85 kPag (about 8 psig to about 12 psig).

Such a dividing wall separation column typically operates in a more energy efficient manner than a simple sidedraw column and also desirably produces a sharper product split than normally obtainable with conventional sidedraw columns.

Further, in accordance with a preferred embodiment, the products produced or formed by or from the dividing wall column may desirably include a distillate having a True Boiling Point (TBP) at the 95% cut point in the range of about 72° to about 78° C. (about 162° to about 172° F.) and, more specifically, about 75° C. (167° F.) and a side product having a TBP at the 5% cut point in the range of about 72° to about 78° C. (about 162° to about 172° F.) and, more specifically, about 75° C. (167° F.) and a TBP at the 95% cut point in the range of about 167° to about 173° C. (about 333° to about 343° F.) and, more specifically, about 170° C. (338° F.).

As will be appreciated by those skilled in the art and guided by the teachings herein provided, such light, intermediate and heavy fraction streams may desirably be appropriately passed such as via corresponding lines 282, 284, and 286, respectively, either for further processing or product recovery, as may be desired.

For example, in the illustrated embodiment, the $C_5$-$C_6$ containing stream in line 282 is passed to a light fraction compound cracking zone 283 wherein at least a portion of the light fraction compounds containing five to six carbon atoms, e.g., $C_5$-$C_6$ olefins, are cracked such as in a manner known in the art to form a cracked olefin effluent comprising $C_2$ and $C_3$ olefins, shown as passing in a line 288 as well as possibly a paraffin purge stream such as in a line 289.

The $C_7$-$C_8$ containing stream in the line 284 can, if desired, be passed for further desired processing such to an aromatics recovery zone 285, for example, wherein aromatic hydrocarbons desirably can be recovered from such the intermediate fraction compounds as a stream in a line 291, in a manner such as is known in the art.

The heavy fraction stream comprising compounds containing more than eight carbon atoms in the line 286 can be passed to a blending zone 287 wherein the heavy fraction compounds containing more than eight carbon atoms are selectively blended into a gasoline hydrocarbon-containing stream, shown as a line 293.

Figure 2:
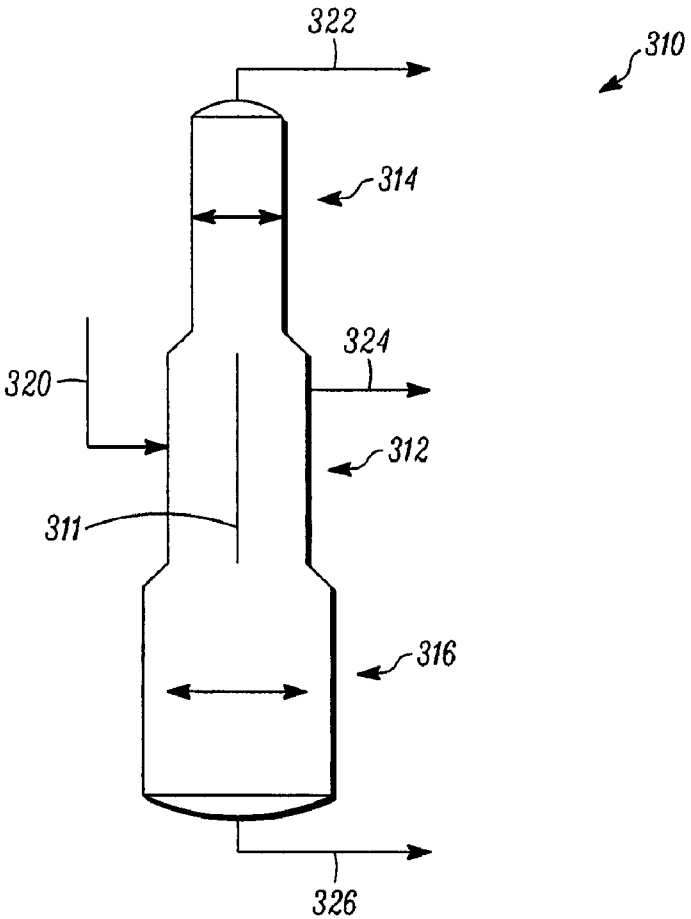
FIG. 2 is a simplified schematic representation of a dividing wall separation column in accordance with one embodiment.

Turning to FIG. 2, there is provided a simplified schematic representation of a dividing wall separation column 310 in accordance with one embodiment. The dividing wall separation column 310 includes a dividing wall 311 positioned therewithin and desirably includes a plurality of stages (not specifically shown) and is generally composed of central or middle dividing wall section, generally designated by the reference numeral 312, as well as an upper or top section 314 and a lower or bottom section 316. As shown, the upper section 314 may desirably be of reduced internal diameter as compared to the central dividing wall section 312 and the lower section 316 may desirably be of increased diameter as compared as compared to the central dividing wall section 312. In accordance with one preferred embodiment, the upper or top section 314 may desirably include in the range of about 4 to about 12 stages, more preferably 8 stages; the central or middle section 312 may desirably include in the range of about 9 to about 17 stages, more preferably 13 stages; and the lower or bottom section 316 may desirably include in the range of about 4 to about 12 stages, more preferably 8 stages.

In accordance with a preferred embodiment and as shown, a naphtha feed can desirably be introduced via a line 320 into the central dividing wall section 312. A light fraction, in accordance with a preferred embodiment, can be withdrawn via a line 322 from the upper or top section 314. An intermediate fraction, in accordance with a preferred embodiment, can be withdrawn as a side product via a line 324 from the central or middle section 312. A heavy fraction, in accordance with a preferred embodiment, can be withdrawn via a line 326 from the lower or bottom section 316.

Thus, through the incorporation and use of dividing wall separation column as herein described, the invention provides sharper desired product splits for FCC effluent processing and does so in a generally more energy efficient manner than heretofore has been realized in the processing of such effluent streams.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A process for treating a naphtha feedstock comprising $C_5$ to $C_9$+ hydrocarbons, said process comprising:

introducing the naphtha feedstock comprising $C_5$ to $C_9$+ hydrocarbons into a dividing wall separation column and separating the feedstock into a light fraction comprising compounds containing five to six carbon atoms, an intermediate fraction comprising compounds containing seven to eight carbon atoms with a True Boiling Point at the 5% cut point in the range of about 162 to about 172° F., and a heavy fraction comprising compounds containing more than eight carbon atoms.

2. The process of claim 1 additionally comprising:

cracking at least a portion of the light fraction compounds containing five to six carbon atoms to form a cracked olefin effluent comprising $C_2$ and $C_3$ olefins.

3. The process of claim 1 additionally comprising:

recovering aromatic hydrocarbons from the intermediate fraction compounds containing seven to eight carbon atoms.

4. The process of claim 1 additionally comprising:

selectively blending the heavy fraction compounds containing more than eight carbon atoms into a gasoline hydrocarbon-containing stream.

5. The process of claim 1 additionally comprising:

catalytically cracking a heavy hydrocarbon feedstock to form the naphtha feedstock.

6. The process of claim 5 wherein the catalytic cracking comprises:

contacting the heavy hydrocarbon feedstock with a hydrocarbon cracking catalyst in a fluidized reactor zone to produce a hydrocarbon effluent comprising a range of hydrocarbon products, including light olefins.

7. The process of claim 6 wherein the hydrocarbon cracking catalyst has a catalyst composition including a first component comprising a large pore molecular sieve and a second component comprising a zeolite with no greater than medium pore size, said zeolite with no greater than medium pore size comprising at least 1.0 wt. % of the catalyst composition.

8. The process of claim 7 wherein said contacting of the heavy hydrocarbon feedstock with a hydrocarbon cracking catalyst comprises contacting the heavy hydrocarbon feedstock with a blended catalyst comprising regenerated catalyst and coked catalyst in a fluidized reactor zone at hydrocarbon cracking reaction conditions to produce a cracked stream containing hydrocarbon products including light olefins.

9. The process of claim 6 additionally comprising:

separating the hydrocarbon effluent in a separation section to form at least one separator liquid stream and a separator vapor stream, the at least one separator liquid stream comprising $C_3$+ hydrocarbons, the separator vapor stream comprising $C_3$− hydrocarbons.

10. The process of claim 9 additionally comprising:

treating the separator vapor stream in an absorption zone to form an absorption zone effluent stream comprising $C_2$− hydrocarbons.

11. The process of claim 10 wherein the treating of the separator vapor stream in an absorption zone to form an absorption zone effluent stream comprises:

contacting the separator vapor stream with a first absorbent solvent in a primary absorber to form a return process stream comprising $C_3$+ hydrocarbons in the first absorbent solvent and an overhead stream comprising $C_2$− materials.

12. The process of claim 11 additionally comprising:

separating $C_2$− materials from the separator liquid stream to form a $C_3$+ process stream; and separating $C_5$+ materials from the $C_3$+ process stream to form a first product process stream comprising $C_5$+ materials and a second product process stream comprising $C_3$ and $C_4$ hydrocarbons.

13. The process of claim 12 additionally comprising:

introducing at least a portion of the first product process stream comprising $C_5$+ materials into the primary absorber as the first absorbent solvent.

14. A process for producing petrochemical feedstocks, said process comprising:

introducing a hydrocarbon feed into a fluid catalytic cracker reactor zone to produce a reactor zone effluent comprising a naphtha feedstock comprising $C_5$ to $C_9$+ hydrocarbons;

recovering at least a portion of the naphtha feedstock comprising $C_5$ to $C_9$+ hydrocarbons from the reactor zone effluent;

introducing at least a portion of the recovered naphtha feedstock comprising $C_5$ to $C_9$+ hydrocarbons into a dividing wall separation column and separating the feedstock into a light fraction comprising compounds containing five to six carbon atoms, an intermediate fraction comprising compounds containing seven to eight carbon atoms with a True Boiling Point at the 5% cut point in the range of about 162 to about 172° F., and a heavy fraction comprising compounds containing more than eight carbon atoms;

cracking at least a portion of the light fraction compounds containing five to six carbon atoms to form a cracked olefin effluent comprising $C_2$ and $C_3$ olefins;

recovering aromatic hydrocarbons from the intermediate fraction compounds containing seven to eight carbon atoms; and selectively blending the heavy fraction compounds containing more than eight carbon atoms into a gasoline hydrocarbon-containing stream.

15. The process of claim 14 wherein the introduction of the hydrocarbon feed into the fluid catalytic cracker reactor zone to produce the reactor zone effluent comprises:

contacting a heavy hydrocarbon feedstock with a hydrocarbon cracking catalyst in the fluidized reactor zone to produce a hydrocarbon effluent comprising a range of hydrocarbon products including light olefins, the hydrocarbon cracking catalyst having a catalyst composition including a first component comprising a large pore molecular sieve and a second component comprising a zeolite with no greater than medium pore size, said zeolite with no greater than medium pore size comprising at least 1.0 wt. % of the catalyst composition.

16. The process of claim 14 wherein the recovery of at least a portion of the naphtha feedstock from the reactor zone effluent comprises:

separating the reactor zone effluent in a separation section to form at least one separator liquid stream and a separator vapor stream, the at least one separator liquid stream comprising $C_3$+ hydrocarbons, the separator vapor stream comprising $C_3$− hydrocarbons.

17. The process of claim 16 additionally comprising:

treating the separator vapor stream in an absorption zone to form an absorption zone effluent stream comprising $C_2$− hydrocarbons.

18. The process of claim 17 wherein the treating of the separator vapor stream in an absorption zone to form an absorption zone effluent stream comprises:

contacting the separator vapor stream with a first absorbent solvent in a primary absorber to form a return process stream comprising $C_3$+ hydrocarbons in the first absorbent solvent and an overhead stream comprising $C_2$− materials.

19. The process of claim 18 additionally comprising:

separating $C_2$− materials from the separator liquid stream to form a $C_3$+ process stream;

separating $C_5$+ materials from the $C_3$+ process stream to form a first product process stream comprising $C_5$+ materials and a second product process stream comprising $C_3$ and $C_4$ hydrocarbons; and introducing at least a portion of the first product process stream comprising $C_5$+ materials into the primary absorber as the first absorbent solvent.

* * * * *